US009340017B2

(12) United States Patent
Fujinami

(10) Patent No.: US 9,340,017 B2
(45) Date of Patent: May 17, 2016

(54) PRINTING APPARATUS

(71) Applicant: CANON KABUSHIKI KAISHA, Tokyo (JP)

(72) Inventor: Yasuyuki Fujinami, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/627,309

(22) Filed: Feb. 20, 2015

(65) Prior Publication Data

US 2015/0258821 A1 Sep. 17, 2015

(30) Foreign Application Priority Data

Mar. 14, 2014 (JP) ..... 2014-051989

(51) Int. Cl.

| | |
|---|---|
| ***B41J 23/00*** | (2006.01) |
| ***B41J 2/14*** | (2006.01) |
| ***B41J 19/14*** | (2006.01) |
| ***B41J 2/17*** | (2006.01) |
| ***B41J 29/38*** | (2006.01) |

(52) U.S. Cl.

CPC *B41J 2/14* (2013.01); *B41J 2/1714* (2013.01); *B41J 19/145* (2013.01); *B41J 29/38* (2013.01)

(58) Field of Classification Search

CPC .... B41J 25/3082; B41J 25/001; B41J 11/005; B41J 25/308

USPC ..... 347/8, 16, 37, 39, 101, 104

See application file for complete search history.

(56) References Cited

U.S. PATENT DOCUMENTS

| | | | | |
|---|---|---|---|---|
| 5,646,653 | A * | 7/1997 | Fujioka | B41J 11/002 347/104 |
| 6,341,858 | B1 * | 1/2002 | Saijo | B41J 2/2114 347/101 |
| 6,561,620 | B2 | 5/2003 | Pietrzyk et al. | |
| 8,172,353 | B2 | 5/2012 | Sugahara | |
| 2004/0027412 | A1 | 2/2004 | Takahashi et al. | |

FOREIGN PATENT DOCUMENTS

| | | | |
|---|---|---|---|
| JP | 2000-263814 | A | 9/2000 |
| JP | 2001-138548 | A | 5/2001 |
| JP | 2002-234152 | A | 8/2002 |
| JP | 2002-361858 | A | 12/2002 |
| JP | 2006-142657 | A | 6/2006 |

OTHER PUBLICATIONS

Office Action issued in Chinese Patent Application No. 201510108859.9, dated Mar. 10, 2016.

* cited by examiner

*Primary Examiner* — An Do

(74) *Attorney, Agent, or Firm* — Fitzpatrick, Cella, Harper & Scinto

(57) ABSTRACT

A printing apparatus that minimizes the amount of ink mist adhering to a rectifying member is provided. A rectifying member can be toggled between a rectifying state for rectification and a retracted state in which the rectifying member is retracted from the rectifying state, and the rectifying member can be kept in the retracted state while the carriage is moving. The rectifying member is toggled to the rectifying state or to the retracted state while the carriage is moving, according to at least one condition from among the distance between the print head and a sheet, and the movement speed of the carriage.

8 Claims, 8 Drawing Sheets

PRINTING APPARATUS

BACKGROUND OF THE INVENTION

1. Field of the Invention

The present invention relates to a printing apparatus that performs printing with a carriage mounted with a print head of inkjet type reciprocating.

2. Description of the Related Art

In an inkjet printing apparatus of a serial-scan type, a carriage mounted with a print head reciprocates relative to a sheet. In this case, an air current is produced along the main scanning direction in the region between the print head and the sheet. In addition, this air current may affect ink ejection from the print head and cause ink impact position errors or the like, which may lower the quality of the printed image.

To address this issue, a proposed configuration provides a skirt member extending outward in the main scanning direction on the print head to regulate the air current flowing through the region between the print head and the sheet. In Japanese Patent Laid-open No. 2006-142657, a skirt member is attached to the print head on the outward side in the main scanning direction, and the skirt member has a folded configuration that abuts a side wall at the ends of the movement range.

In the apparatus disclosed in Japanese Patent Laid-open No. 2006-142657, during printing operation, the skirt member is always in a lowered state to regulate the air current. For this reason, the ink mist produced due to the ejection of ink during printing adheres to bottom face of the skirt member, and the skirt member gradually becomes soiled with ink. If this soiling ink adheres to the facing sheet for some reason, the quality of the printed image is lowered.

SUMMARY OF THE INVENTION

In view of the above circumstances, an objective of the present invention is to minimize the lowering of printed image quality compared to the related art.

According to the present invention, a printing apparatus includes a carriage that performs reciprocating movement, mounted with a print head that ejects ink; a rectifying member, extending from the carriage in a movement direction of the carriage, that rectifies air flowing under the print head when the carriage moves, wherein the rectifying member can be toggled between a rectifying state and a retracted state; and a mechanism that keeps the rectifying member in the retracted state while the carriage moves, and the rectifying member is toggled by a movement of the carriage.

According to the present invention, a printing apparatus includes a carriage that performs reciprocating movement, mounted with a print head that ejects ink; and a rectifying member, extending from the carriage in a movement direction of the carriage, that rectifies air flowing under the print head when the carriage moves, wherein the rectifying member can be toggled between a rectifying state and a retracted state, and wherein the rectifying member is set to the rectifying state or to the retracted state according to at least one of a distance between the print head and a sheet, and a movement speed of the carriage.

According to the present invention, by retracting a rectifying member under certain conditions, the degradation of image quality may be further minimized compared to the related art.

Further features of the present invention will become apparent from the following description of exemplary embodiments (with reference to the attached drawings).

DESCRIPTION OF THE EMBODIMENTS

First Embodiment

Figure 1:
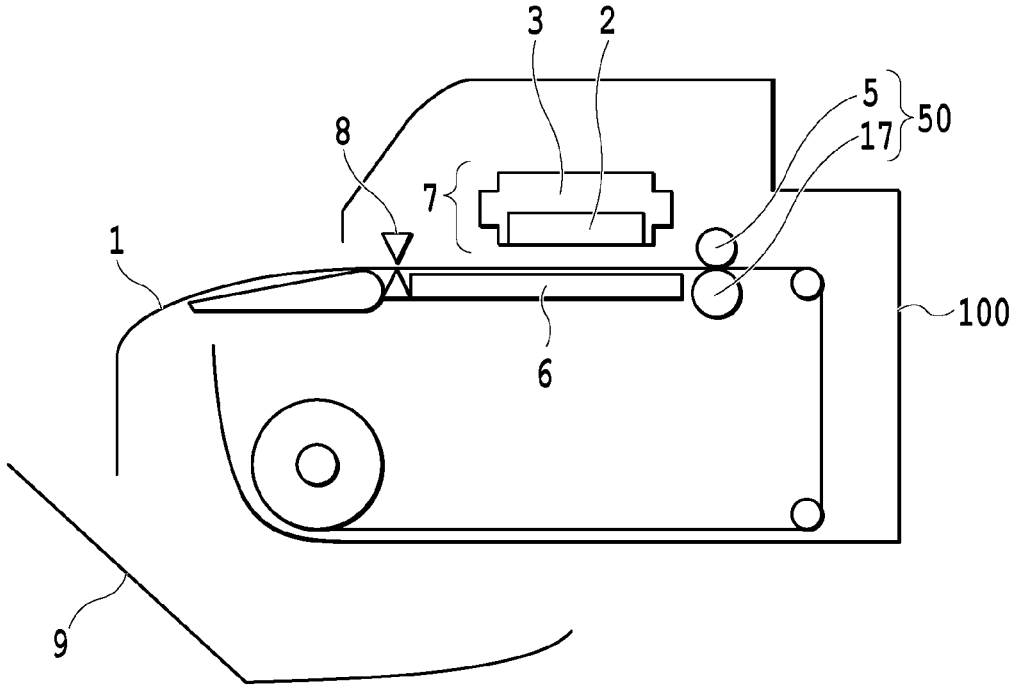
FIG. 1 is a cross-section view illustrating an overall configuration of an inkjet printing apparatus according to the first embodiment of the present invention.

An inkjet printing apparatus 100 according to the first embodiment of the present invention will be described. FIG. 1 illustrates a schematic cross-section view of an inkjet printing apparatus 100 according to the first embodiment.

The inkjet printing apparatus 100 includes a printing unit 7, a platen 6, a conveyance roller pair 50, and a cutter 8. The printing unit 7 includes a print head 2 and a carriage 3. The print head 2 is mountable onto the carriage 3. A plurality of ejection ports are formed in the print head 2, and ejection port arrays are formed by arrangement of the plurality of ejection ports in array. By mounting the print head 2 onto the carriage 3 and ejecting ink droplets from the print head 2 onto a sheet (a print medium), printing may be conducted.

The conveyance roller pair 50 is disposed upstream to the printing unit 7. The conveyance roller pair 50 includes a conveyance roller 17 and a pinch roller 5. The pinch roller 5 is attached with a bias in the direction towards the conveyance roller 17. For this reason, by rotationally driving the conveyance roller 17 while a sheet is caught between the conveyance roller 17 and the pinch roller 5, the sheet is conveyed along a conveyance path.

Printing is performed by ejecting ink droplets onto a sheet 1 by the print head 2 at a position opposed to the print head 2. Printing is performed while the sheet 1 is supported on a platen 6 installed nearly horizontally. When printing onto the sheet 1, the print head 2 prints by ejecting ink droplets onto the sheet 1 while the carriage 3 mounted with the print head 2 moves in the main scanning direction intersecting the conveyance direction of the sheet 1. The inkjet printing apparatus 100 performs printing by repeating a printing operation that ejects ink droplets towards the sheet 1 while moving the print head 2 in the main scanning direction, and a conveyance operation that conveys the sheet 1 in the conveyance direction by a distance equal to the printing width. The part of the sheet 1 that has finished printing is cut by the cutter 8 and discharged into a basket 9.

Figure 2A:
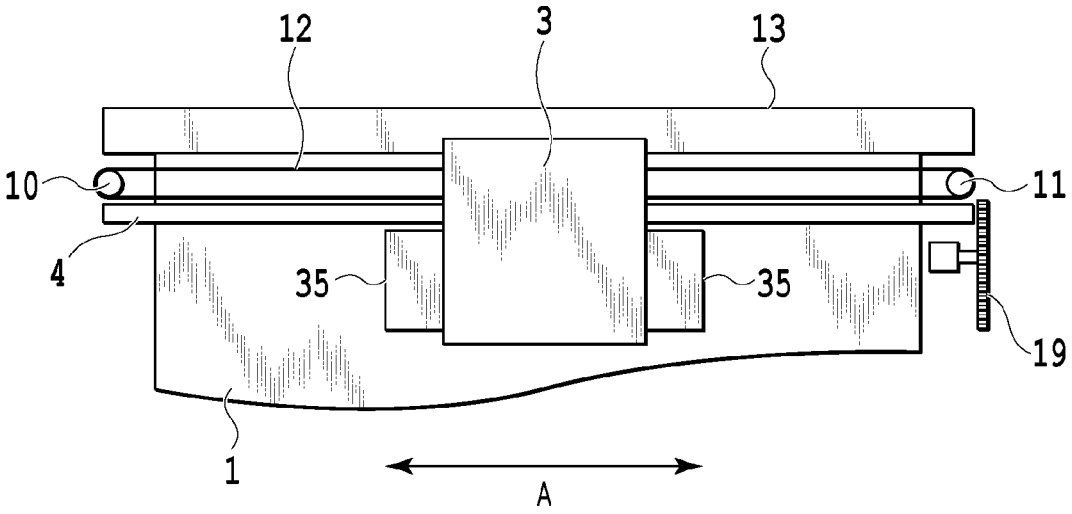
FIGS. 2A and 2B are schematic diagrams illustrating the area near a print head.
Figure 2B:
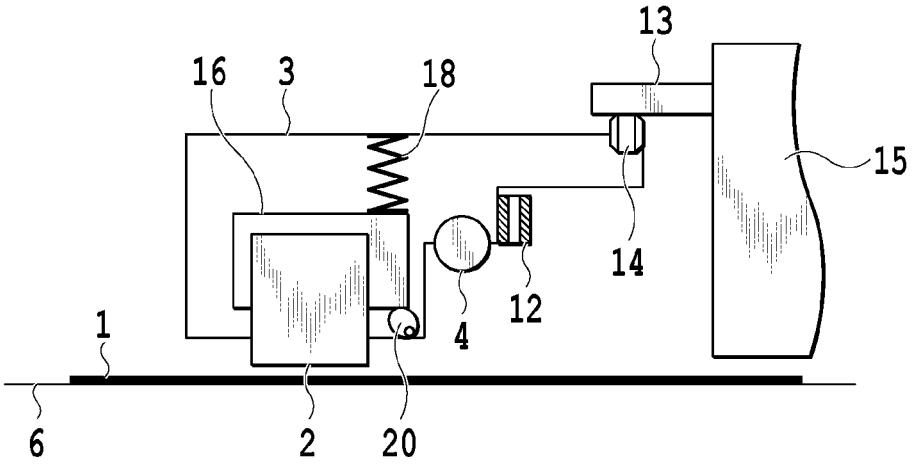

FIG. 2A illustrates a plane view as seen from above the vicinity of the printing unit 7 in FIG. 1, while FIG. 2B illustrates a schematic cross-section view as seen from the side of the vicinity of the printing unit 7 in FIG. 1.

The carriage 3 mounted with the print head 2 is guided and supported by a first guide rail 4, and able to slide freely. Additionally, a second guide rail 13 extending parallel to the first guide rail 4 is installed on a frame 15. The carriage 3 abuts and is supported by the second guide rail 13 via a freely rotating positioning roller 14. A timing belt 12 linked to the carriage 3 is looped around a pulley-attached carriage motor 10 (only the pulley is illustrated) and an idle pulley 11, and the carriage 3 reciprocates in the main scanning direction (the direction of the arrow A) due to the driving of the carriage motor 10.

Also, as illustrated in FIG. 2B, the print head 2 is attached to a head holder 16. The head holder 16 is attached so as to abut a cam 20 while being pushed by a spring 18 and biased in a direction towards the cam 20. For this reason, by adjusting the position of the abutting face of the cam 20 on the head holder 16, the position of the head holder 16 and the print head 2 may be positioned with respect to the carriage 3. By causing the cam 20 to rotate, the position of the print head 2 with respect to the carriage 3 may be changed. In other words, the distance between the print head 2 and the sheet 1, or in other words the head position, may be selectively toggled when performing printing operation.

Toggling of the head position is performed by causing the carriage 3 to move to an end of the reciprocating region, and with a cam driving mechanism 19 and the cam 20 of the carriage 3 in an engaged state, causing the cam 20 to rotate to a predetermined phase by driving the cam driving mechanism 19. The purpose of selectively toggling between multiple head positions is to enable the inkjet printing apparatus 100 to perform printing on multiple types of sheets. In the present embodiment, printing may be performed on types of the sheet 1 from approximately 0.1 mm to approximately 0.8 mm thick.

To maintain good image quality in the printed image, when performing printing, it is preferable to preconfigure the distance between the surface on which the ejection ports are formed on the print head 2 and the print surface of the sheet 1 (the head/medium distance) to be in a suitable range. This distance roughly ranges from 1.0 mm to 2.0 mm approximately. Typically, the closer the distance between the ejection port forming face on which the ejection ports are formed on the print head 2 and the sheet 1, the better the image quality of the obtained printed image. However, depending on the type of sheet, the sheet may absorb the water component included in ink droplets ejected from the print head 2 in order to form an image, thereby causing the surface of the sheet to undulate and rise upward. In this case, contact between the print head 2 and the sheet 1 may cause ink adhering to the ejection port forming face of the print head 2 to adhere to and soil the sheet, or increase the possibility of the sheet becoming jammed. For this reason, the control unit changes the head position to a suitable value in accordance with a control program saved in ROM, on the basis of various conditions such as the type of the sheet 1, the ambient temperature, a measured value of humidity, and the image data to be printed.

Additionally, in the carriage 3, a skirt member (rectifying member) 35 extending along the main scanning direction is provided on the sides of the carriage 3. In the present embodiment, the skirt member 35 is attached to the outer ends of the carriage 3 in the main scanning direction. The skirt member 35 is made up of planar member.

Figure 3:
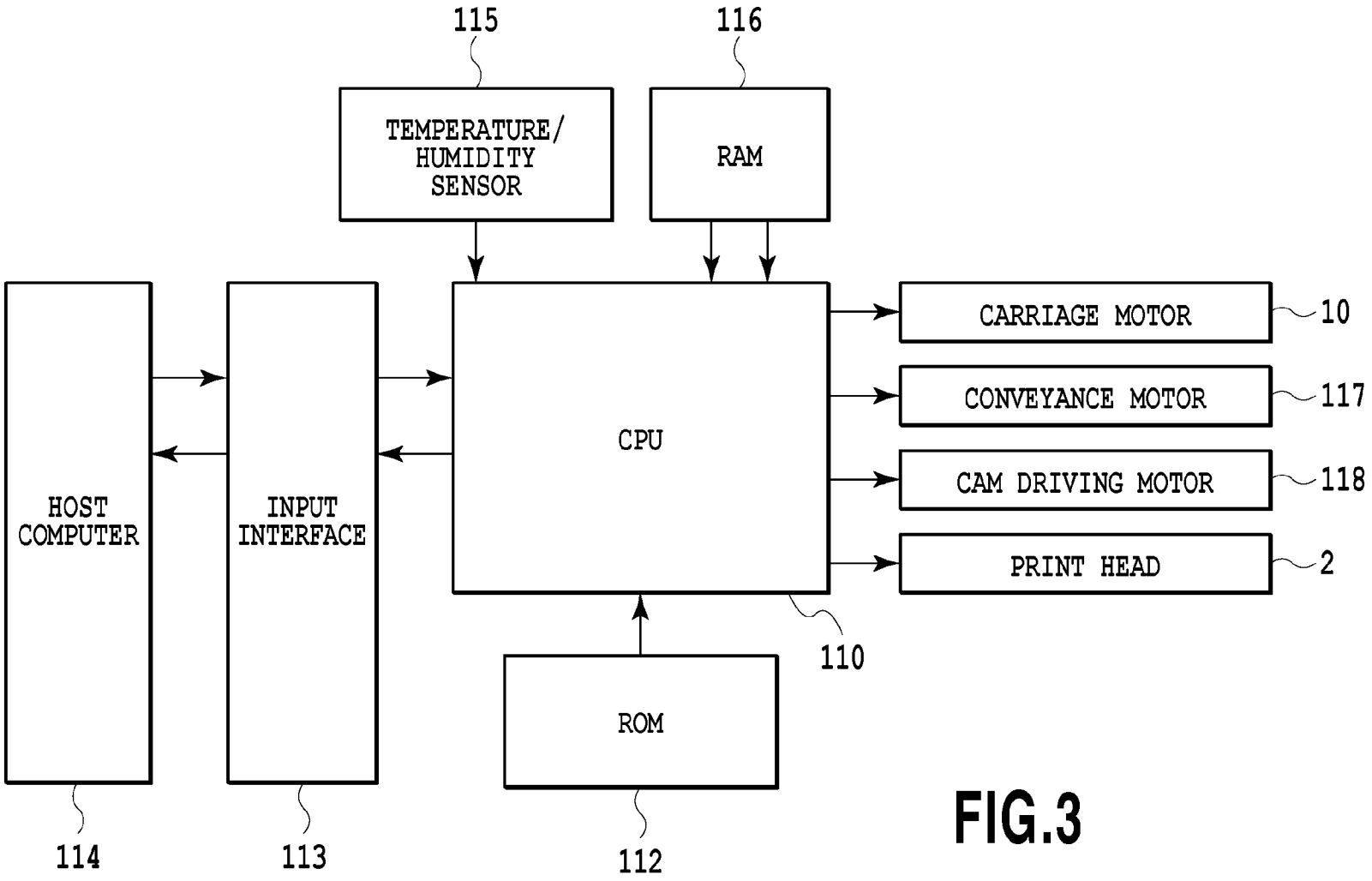
FIG. 3 is a block diagram illustrating a system configuration of a control unit.

FIG. 3 illustrates block diagram illustrating a system configuration of the control unit of the inkjet printing apparatus 100. When performing printing operation, information such as the type of sheet to be used, print image data, and print mode settings information is input from a host computer 114 into a CPU 110 via an input interface 113. The CPU 110, on the basis of this information as well as information such as measured values from a temperature/humidity sensor 115, decides a suitable position of the print head for the head position in accordance with a control program stored in ROM 112. Herein, the head position refers to a position along the direction of moving closer to or away from the sheet 1. After a head position for printing is decided, a cam driving motor 118 is driven, and the position of the print head 2 is set to the decided head position. Subsequently, the CPU controls components such as a transport motor 117, the carriage motor 10, and the print head 2 to perform printing operation. In the printing operation, as described above, an operation of printing onto the sheet by ejecting ink droplets from the print head 2 while moving the carriage 3, and an operation of conveying the sheet 1 by rotationally driving the conveyance roller 17, are repeatedly performed in alternation.

Figure 4:
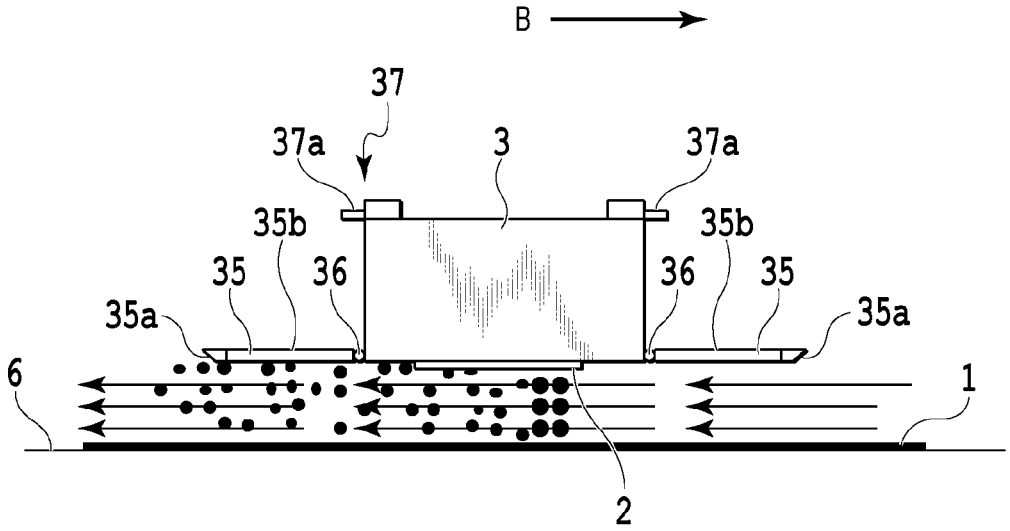
FIG. 4 is a diagram explaining an air current and a flow of ink mist between a print head and a print surface when a carriage moves.

Next, the skirt member 35 provided on the carriage 3 will be described. FIG. 4 illustrates a front view of the carriage 3 with the skirt member 35 attached. The skirt member 35 is provided on both sides of the carriage 3 so as to extend from both sides the carriage 3 in the movement direction of the carriage 3. The skirt member 35 is supported on the carriage 3, and is able to freely rotate about a rotating shaft 36. In addition, the skirt member 35 is attached to the carriage 3 so as to maintain orientation at a position facing the sheet 1.

A magnet catch 37 is attached to the carriage 3. If the skirt member 35 rotates so that the position of an edge 35*a* on the skirt member 35 moves away from the sheet 1, and the skirt member 35 moves to a position nearly orthogonal to the plane of the sheet 1, the magnet catch 37 catches and holds the skirt member 35 at that position. After the magnet catch 37 catches the skirt member 35, the skirt member 35 is maintained in a retracted state at that position. In other words, the magnet catch 37 is provided as a mechanism that keeps the skirt member 35 in the retracted state while the carriage 3 is moving. The magnet catch 37 is typically used on objects such as doors, and a catch mechanism 37*a* couples with or separates from a magnet 35*e* on the skirt member 35 by magnetic force. In the present embodiment, magnets are attached to the catch mechanism 37*a* and the magnet 35*e* (coupling means). If the catch mechanism 37*a* and the magnet 35*e* are made to abut, the two become coupled by magnetic force. From the coupled state, if the catch mechanism 37*a* is pushed again, a lever 41 projects outward due to the action of a spring provided inside the catch mechanism 37*a* (FIG. 6), causing the catch mechanism 37*a* and the magnet 35*e* to oppose the magnetic force and become separated.

When the carriage 3 scans across the sheet 1 in the direction B, an air current is produced between the carriage 3 and print head 2, and the sheet 1. The skirt member 35 is attached to the carriage 3 to rectify the air current produced at this point. Since the air current flowing between the print head 2 and the sheet 1 is rectified by the skirt member 35, the impact accuracy of ink droplets ejected by the print head 2 is kept high, and the quality of the printed image obtained by printing is kept high.

Meanwhile, under certain conditions, an ink mist produced due to the ejection of ink droplets from the print head 2 adheres to the bottom face of the skirt member 35, and the sheet 1 is more likely to become soiled. To address this issue, in the present embodiment, the skirt member is configured to be retractable while the carriage is moving, in order to reduce the adherence of ink mist onto the skirt member. Specifically, when the rectifying effect is desired, the skirt member 35 is positioned in a state enabling the rectification of the air current between the print head 2 and the sheet 1 (rectifying state). On the other hand, under conditions in which a good printed image is obtained even without rectification, the skirt member 35 is retracted to a position at which the skirt member 35 is retracted from the rectifying state (retracted state). According to a predetermined condition, the control unit selects either the rectifying state for rectifying the air current between the print head 2 and the sheet 1 while the carriage moves during printing, or the retracted state in which the skirt member 35 is retracted from the ejection port forming face of the print head 2.

The predetermined condition is a factor that degrades an image formed on a sheet. In the present embodiment, the distance between the print head 2 and the sheet 1 (the head/medium distance) is used as the predetermined condition. As the head/medium distance becomes smaller, the possibility of contact between the bottom face of the rectifying member and the facing sheet becomes higher. Since a sheet that has absorbed ink applied by a print head is more likely to undulate due to cockling, there is a higher possibility of the sheet contacting the bottom face of the rectifying member on the downstream side that passes over the sheet surface immediately after passing of the print head. If contact occurs, the image quality of the sheet degrades due to image smearing. Also, ink mist adhering to the bottom face of the rectifying member may adhere to and soil the sheet. On the other hand, if the head/medium distance is increased, such problems do not occur, even if cockling is produced.

Considered from a different standpoint, if the head/medium distance increases, more air flows in between the print head 2 and the sheet 1, and thus turbulence occurs more readily. This degrades image quality due to the "mist haze" resulting from more ink mist adhering on top of the image formed by the print head. For this reason, rectification on the upstream side is desirable. On the other hand, if the head/medium distance is decreased, such problems occur less readily.

Given the above standpoint, in the present embodiment, the state of the skirt member 35 is changed according to the head/medium distance. Specifically, when printing is performed with a head/medium distance that produces a large gap exceeding a configured threshold value, the skirt member is put into the rectifying state. On the other hand, when printing is performed with a head/medium distance that produces a small gap not exceeding a configured threshold value, the skirt member is put into the retracted state. These states are toggled under control by the control unit.

Herein, to "retract" the skirt member means to move the skirt member from the position where the skirt member rectifies the air current flowing between the print head 2 and the sheet 1, to a position where the amount of adhering ink mist is reduced. For example, this includes rotational movement by the skirt member 35 rotatably supported with respect to the carriage, from a position where the skirt member 35 rectifies the air current flowing between the print head 2 and the sheet 1, in a direction moving away from the ejection ports of the print head 2. This also includes movement along the direction of moving closer to or away from the sheet 1, in a direction moving away from the ejection ports of the print head 2. This also includes movement in a direction moving away from the ejection ports of the print head 2 by sliding movement in a direction parallel to the sheet 1. Additionally, this also includes movement for which the amount of adhering ink mist is reduced by storing the skirt member inside the carriage 3 as a result of the movement. "Retracting" may also include movement in another direction, insofar as the amount of adhering ink mist is reduced as a result of the movement compared to the position where the skirt member rectifies the air current flowing between the print head 2 and the sheet 1.

Features of the present embodiment based on the basic concept of the above solution will be described in further detail below.

FIGS. 5A to 5D are front views illustrating how two skirt members 35 transition from the rectifying state to the retracted state. In the inkjet printing apparatus 100, body frame side plates (stationary parts) 102 and 103 are disposed at the end positions of the movable range of the carriage 3.

Figure 5A:
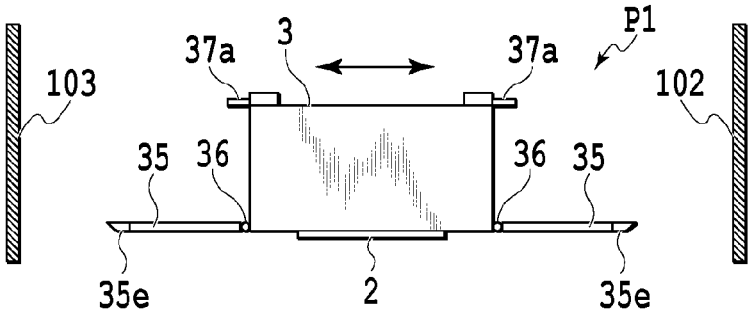
FIGS. 5A to 5D are front views illustrating states of a skirt member transitioning from a rectifying state to a retracted state.

FIG. 5A illustrates a front view of the carriage 3 and the print head 2 for a state in which both of the two skirt members 35 are disposed in a position facing the sheet 1 to rectify the air current between the print head 2 and the sheet 1. This state in which both of the two skirt members 35 are disposed in a position facing the sheet 1 to rectify the air current between the print head 2 and the sheet 1 (the rectifying state) is designated a first state P1.

The inkjet printing apparatus 100 is able to change the state of the carriage 3 from the first state P1 to a second state P2 (FIG. 5D) in which both skirt members 35 are retracted to a position that reduces the amount of adhering ink mist. The skirt members 35 will be described as the carriage 3 transitions from the first state P1 to the second state P2.

Figure 5B:
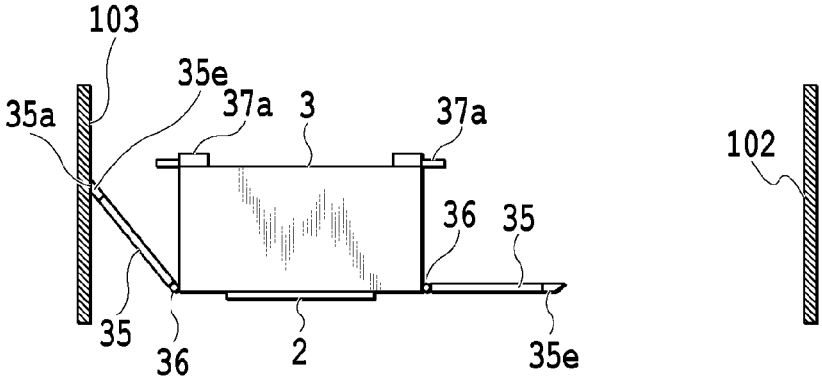

The carriage 3 moves to a position where the edge 35*a* of one of the skirt members 35 contacts the side plate 103 on one side. If the carriage 3 moves farther in the same direction, the edge of the skirt member 35 abuts the side plate 103. Subsequently, as illustrated in FIG. 5B, the edge 35*a* of the skirt member 35 rises along the side plate 103. To induce the skirt member 35 to always move upward during the abutting, the edge 35*a* of the skirt member 35 has a diagonally cut shape. A guiding sloped face may also be provided on the abutting part of the wall face of the side plate 103. As the carriage 3 approaches the ends of the movable range, the skirt members 35 that were in the rectifying state toggle to the retracted state by rotating while part of the skirt members 35 abut the side plates 102 and 103 inside the device.

In this way, by having the skirt member 35 rotate about the rotating shaft 36 of a hinge mechanism, the edge 35*a* of the skirt member 35 moves in a direction away from the sheet 1. After the skirt member 35 reaches an orientation that is nearly orthogonal to the plane of the sheet 1 as a result of the skirt member 35 rotating about the rotating shaft 36, the magnet 35*e* attached near the tip of the skirt member 35 abuts the catch mechanism 37*a*. At this point, a pulley or the like may also be provided on the part of the skirt member 35 that slides against the side plate 103 to make the movement of the skirt member 35 smoother.

Figure 5C:
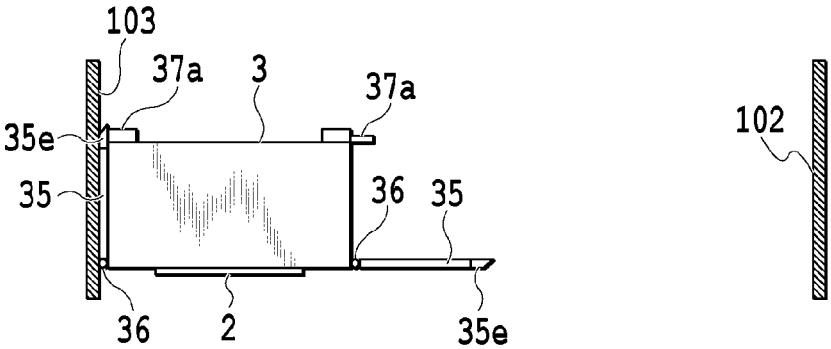

As illustrated in FIG. 5C, after the skirt member 35 stands upright and the magnet 35*e* abuts the catch mechanism 37*a*, the magnet 35*e* and the catch mechanism 37*a* become coupled as a result, and the orientation of the skirt member 35 is held in place. The orientation of the skirt member 35 is held in the state extending in the direction nearly orthogonal to the plane of the sheet 1, in a retracted state from the ejection port forming face of the print head 2 so as to reduce the amount of adhering ink mist. The magnet catch 37 holds the skirt member 35 toggled to the retracted state using the magnetic force of a magnet, and keeps the skirt member 35 from returning to the rectifying state due to the weight of the skirt member 35 itself.

In this way, after one of the skirt members 35 is retracted to a position that reduces the amount of adhering ink mist, the other skirt member 35 is similarly retracted to a position that reduces the amount of adhering ink mist. The carriage 3 moves to a position where the edge 35*a* of the skirt member 35 on the opposite side of the skirt member 35 held by the magnet catch 37 contacts the other side plate 102. If the carriage 3 moves farther in the same direction, the edge 35*a* rises along the side plate 102. As discussed above, the edge 35*a* on the opposite side likewise has a diagonally cut shape.

Figure 5D:
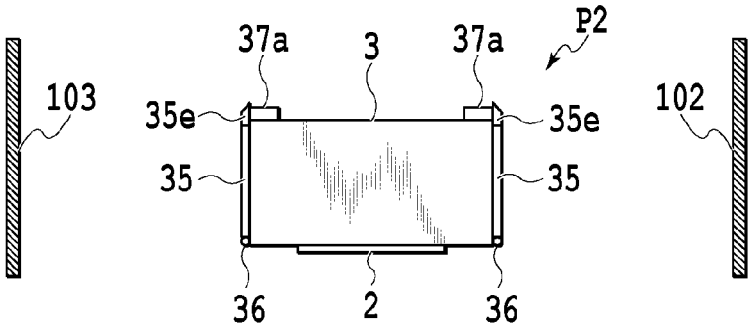

In this way, by having the skirt member 35 on the opposite side likewise rotate about the rotating shaft 36, the edge 35*a* of the skirt member 35 on the opposite side moves in a direction away from the sheet 1. After the skirt member 35 on the opposite side reaches an orientation that is nearly orthogonal to the plane of the sheet 1, the magnet 35*e* attached near the tip of the skirt member 35 abuts the catch mechanism 37*a*, and the orientation of the skirt member 35 is maintained. After the skirt member 35 on the opposite side is retracted to a position that reduces the amount of adhering ink mist, the carriage 3 enters the second state P2 in which both skirt members 35 are retracted to a position that reduces the amount of adhering ink mist, as illustrated in FIG. 5D.

In this way, the inkjet printing apparatus 100 includes a moving configuration that moves the skirt member 35 between a rectifying state for rectifying the air current flowing between the print head and the sheet, and a retracted state that retracts the skirt member 35 from the rectifying state. In the present embodiment, by abutting the skirt members 35 against the side plates 102 and 103, and moving the carriage 3 farther in the same direction to push the skirt members 35 onto the side plates 102 and 103, the skirt members 35 are retracted.

In the case of returning the position of the skirt members 35 back to the first state P1 when the position of the skirt members 35 is arranged in the second state P2, the skirt members 35 are again made to abut the side plates 102 and 103. By moving the carriage 3 to the ends of the movable range and causing the skirt members 35 to abut the side plates 102 and 103, the catch mechanism 37*a* of the magnet catch 37 holding the skirt members 35 is pushed inward. At this point, the action of a spring provided inside the catch mechanism 37*a* works to oppose the magnetic force and uncouple, and thereby separate the catch mechanism 37*a* from the magnet 35*e*. Consequently, the skirt members 35 rotate in the direction opposite the direction of retraction, and move to a position facing the sheet 1. As a result, by releasing the hold of the magnet catch 37 on the skirt member 35 for both skirt members 35, the skirt members 35 can be reversed to the first state P1 again.

In this way, when toggling the position of the skirt members 35, the carriage 3 is moved to a toggle position near the ends of the reciprocating movement. Also, when maintaining the position of the skirt members 35 without toggling, the carriage 3 reciprocates by reversing direction farther inward than the toggle position. Herein, the toggle position is the position of the carriage 3 at which the skirt members 35 are caught by the catch mechanism when the skirt members 35 are in the rectifying state, and at which the caught state of the skirt members 35 is released when the skirt members 35 are being held in the retracted state.

Figure 6A:
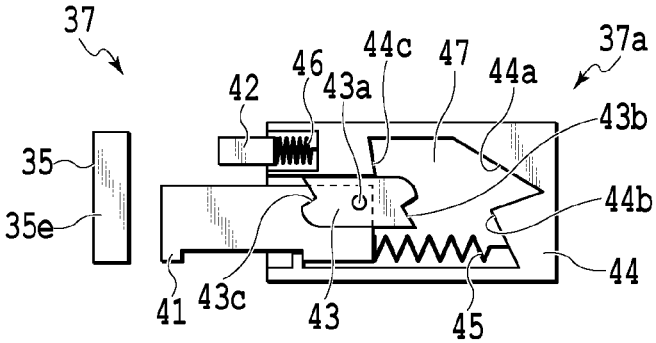
FIGS. 6A to 6E are diagrams explaining a magnetic catch that catches and maintains the orientation of a skirt member that has transitioned to the retracted state.

Next, FIGS. 6A to 6E will be used to describe the structure and operation of the magnet catch 37 in greater detail. FIG. 6A is a plan view, as seen from above the carriage 3, of the catch mechanism 37*a* in the magnet catch 37 at the stage prior to catching a skirt member 35. A magnet 42 is attached via a spring 46 to a catch mechanism case 44 of the catch mechanism 37*a*. In addition, a lever (projecting member) 41 is provided inside the catch mechanism case 44, and is slidable along the main scanning direction. Also, the catch mechanism case 44 includes a storage region 47 able to store the lever 41. The lever 41 is attached with a bias imparted by a spring 45 in the direction towards the skirt member 35. A rotor 43 is attached to the lever 41, and is rotatable about a rotating shaft 43*a*.

A depression 43*b* (first interlocking part) is formed in the rotor 43. A projection 44*b* corresponding to the shape of the depression 43*b* formed in the rotor is formed in an inner wall 44*a* of the catch mechanism case 44. In addition, a depression 43*c* (second interlocking part) is formed in the rotor 43 at a position on the opposite side of the depression 43*b*. The rotor 43 has a point-symmetric shape about the rotating shaft 43*a*. In addition, a projection 44*c* is formed in the inner wall 44*a* of the catch mechanism case 44, in correspondence with the depression 43*c* formed in the rotor 43. In this way, there is formed in the rotor 43 depression 43*b* that interlocks with part of the wall face defining the storage region 47 when the lever 41 is pushed inward into the catch mechanism case 44. Also, there is formed in the rotor 43 depression 43*c* that interlocks with part of the wall face defining the storage region 47 at a separate position from the depression 43*b* when the pushing of the lever 41 inward into the catch mechanism case 44 is released.

Operation will be described for when the magnet 35*e* of a skirt member 35 is caught and held by the catch mechanism 37*a*. As a result of the skirt member 35 moving to the retracted position, the magnet 35*e* of the skirt member 35 approaches the lever 41 of the catch mechanism 37*a*, as illustrated in FIG. 6A. The magnet 35*e* abuts the lever 41, and subsequently the skirt member 35 moves farther towards the catch mechanism 37*a*, thereby causing the magnet 35*e* to push the lever 41 inward into the catch mechanism case 44.

Figure 6B:
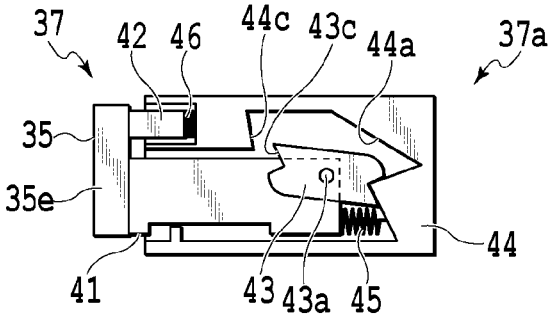

After the lever 41 is pushed inward into the catch mechanism case 44, the rotor 43 abuts the projection 44*b* formed in the catch mechanism case 44, and the position of the lever 41 is restrained, as illustrated in FIG. 6B. In this way, positioning of the rotor 43 is performed as a result of the depression 43*b* of the rotor 43 interlocking with the projection 44*b* formed in the catch mechanism case 44. Also, at this point, the spring 45 disposed between the rotor 43 and the catch mechanism case 44 is compressed and made to exert force on the rotor 43 in the direction of the skirt member 35. At this point, when the magnet 35*e* in the skirt member 35 abuts the magnet 42, the magnet 35*e* and the magnet 42 are coupled to each other by magnetic force.

Figure 6C:
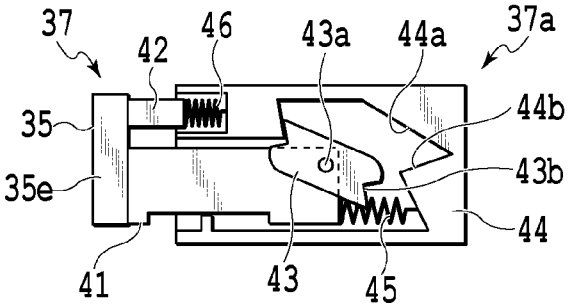

After the lever 41 has been pushed inward into the catch mechanism case 44, if the pushing on the lever 41 of the skirt member 35 is released, the lever 41 returns towards the skirt member 35 due to the restoring force of the spring 45. After the lever 41 moves in the direction towards the skirt member 35 and the rotor 43 abuts the catch mechanism case 44, the depression 43*c* formed in the rotor 43 interlocks with the projection 44*c* formed in the catch mechanism case 44, as illustrated in FIG. 6C. Consequently, the movement of the lever 41 in the direction towards the skirt member 35 is restrained. In other words, when the pushing on the lever 41 is released, the interlocking between the depression 43*c* of the rotor 43 and the projection 44*c* of the catch mechanism case 44 causes the lever 41 to be supported by the wall face defining the storage region 47. In this way, the interlocking between the depression 43*c* of the rotor 43 and the projection 44*c* of the catch mechanism case 44 restrains the movement of the lever 41 towards the skirt member 35, thereby maintaining the magnetic coupling between the magnet 35*e* and the magnet 42. Consequently, the orientation of the skirt member 35 can be maintained in a state with the magnet 35*e* of the skirt member 35 still caught by the catch mechanism 37*a*.

Figure 6D:
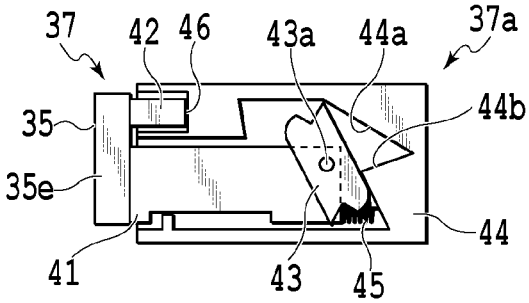

When releasing the catch on the magnet 35*e* of the skirt member 35 by the catch mechanism 37*a*, from the state illustrated in FIG. 6C, the magnet 35*e* of the skirt member 35 is again moved towards the catch mechanism case 44. As a result, the lever 41 is pushed farther inward into the catch mechanism case 44. After the lever 41 is pushed farther inward into the catch mechanism case 44, the rotor 43 abuts the projection 44*b* of the catch mechanism case 44, as illustrated in FIG. 6D. At this point, the rotor 43 rotates about the rotating shaft 43*a*. In other words, when the depression 43*c* of the rotor 43 interlocks with the projection 44*c* and the lever 41 is pushed inward into the storage region 47 with the lever 41 in a supported state, the rotor 43 abuts the wall face defining the storage region 47, and the rotor 43 rotates.

Figure 6E:
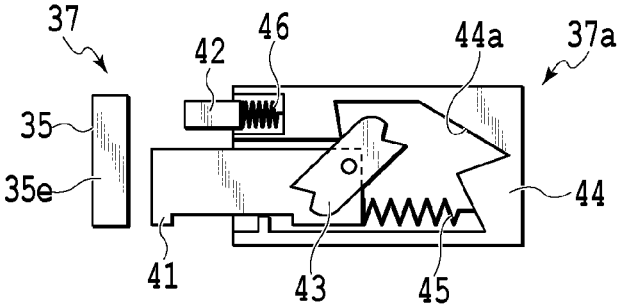

After the force of the magnet 35*e* of the skirt member 35 pushing the lever 41 inward into the catch mechanism case 44 is removed, the restoring force of the spring 45 pushes the rotor 43 and the lever 41 out towards the skirt member 35. Consequently, as illustrated in FIG. 6E, the rotor 43 and the lever 41 moves towards the skirt member 35, and part of the lever 41 projects out from the catch mechanism case 44. In other words, after the pushing by the lever 41 is released, the lever 41 projects out from the catch mechanism case 44 of the catch mechanism 37*a* without the rotor 43 interlocking with the wall face defining the storage region 47. At this point, the restoring force of the spring 45, via the lever 41, causes the magnet 35*e* of the skirt member 35 to receive force in the direction moving away from the catch mechanism case 44. In other words, the magnet 35*e* of the skirt member 35 receives force in the direction moving away from the catch mechanism 37*a* via the lever 41. The force received by the skirt member 35 at this point causes the magnet 35*e* of the skirt member 35 to separate from the magnet 42 of the catch mechanism 37*a*, and the skirt member 35 moves away from the catch mechanism 37*a*. Consequently, the state of the skirt member 35 being held by the catch mechanism 37*a* is released.

In this way, a toggle mechanism able to hold or release the skirt member 35 as a result of the magnet catch being abutted by the skirt member 35 is configured. When the skirt member 35 is in the rectifying state, if the carriage 3 approaches the end of the movement range and the skirt member 35 abuts the side plate 102 or 103, the skirt member 35 is held by the magnet catch 37. When the skirt member 35 is in the retracted state, if the carriage 3 approaches the end of the movement range and the skirt member 35 abuts the side plate 102 or 103, the hold on the skirt member 35 by the magnet catch 37 is released.

Note that although the present embodiment describes a configuration in which magnets are attached to both of the catch mechanism 37*a* and the magnet 35*e*, the present invention is not limited thereto, and a configuration in which a magnet is attached to at least one of the catch mechanism 37*a* and the magnet 35*e* is also acceptable. It is sufficient to couple the catch mechanism 37*a* and the magnet 35*e* by magnetic force, and maintain the orientation of the skirt member 35 in the retracted state. Also, although the above embodiment describes a configuration in which the skirt member 35 and the catch mechanism 37*a* are coupled by magnetic force, a configuration in which the skirt member 35 and the catch mechanism 37*a* are coupled by another configuration is also acceptable.

When printing is performed by ejecting ink from the print head 2, the carriage 3 reciprocates in a range that does not abut the side plates 102 and 103 of the body frame. During the printing of an image on a single sheet, the orientation of the skirt member 35 is maintained in the first state P1 or the second state P2.

Next, toggling between the first state P1 and the second state P2 will be described. As described above, the state during printing is toggled between the first state P1 and the second state P2 according to the distance between the print surface of the sheet 1 and the print head 2 (the head/medium distance).

When the head/medium distance is greater than a configured threshold value, printing operation is performed with both of the two skirt members 35 in the first state P1, which is the rectifying state. As described above, when the skirt member 35 of the carriage 3 is in the first state P1, the air current between the print head 2 and the sheet 1 can be rectified. Consequently, the impact accuracy of ink droplets ejected from the print head 2 and impact on the sheet 1 can be kept high, and since the effects of "mist haze" are also small, the quality of the printed image can be kept high.

On the other hand, when the head/medium distance is less than a configured threshold value, printing operation is performed in the second state P2 in which both of the two skirt members 35 is the retracted state. As described above, when the gap is small, the quality of the printed image can be kept high even without rectification. Also, if the rectifying member is retracted when not needed, further soiling of the bottom face of the rectifying member is minimized. Soiling of the sheet caused by accumulated ink mist on the bottom face of the rectifying member dripping onto the sheet is minimized, and as a result, good image quality can be maintained over a longer period compared to the related art.

Hypothetically, if printing operation is performed in the first state P1 when the gap is small, likelihood of contact between a sheet with cockling and the bottom face of the rectifying member becomes higher. If contact occurs, image smearing may occur, and accumulating ink mist on the bottom face of the rectifying member may adhere to and soil the sheet. Furthermore, the bottom face of the skirt member 35 is soiled further, and there is a higher likelihood of ink mist falling onto the sheet 1 as droplets and soiling the sheet 1.

Figure 7:
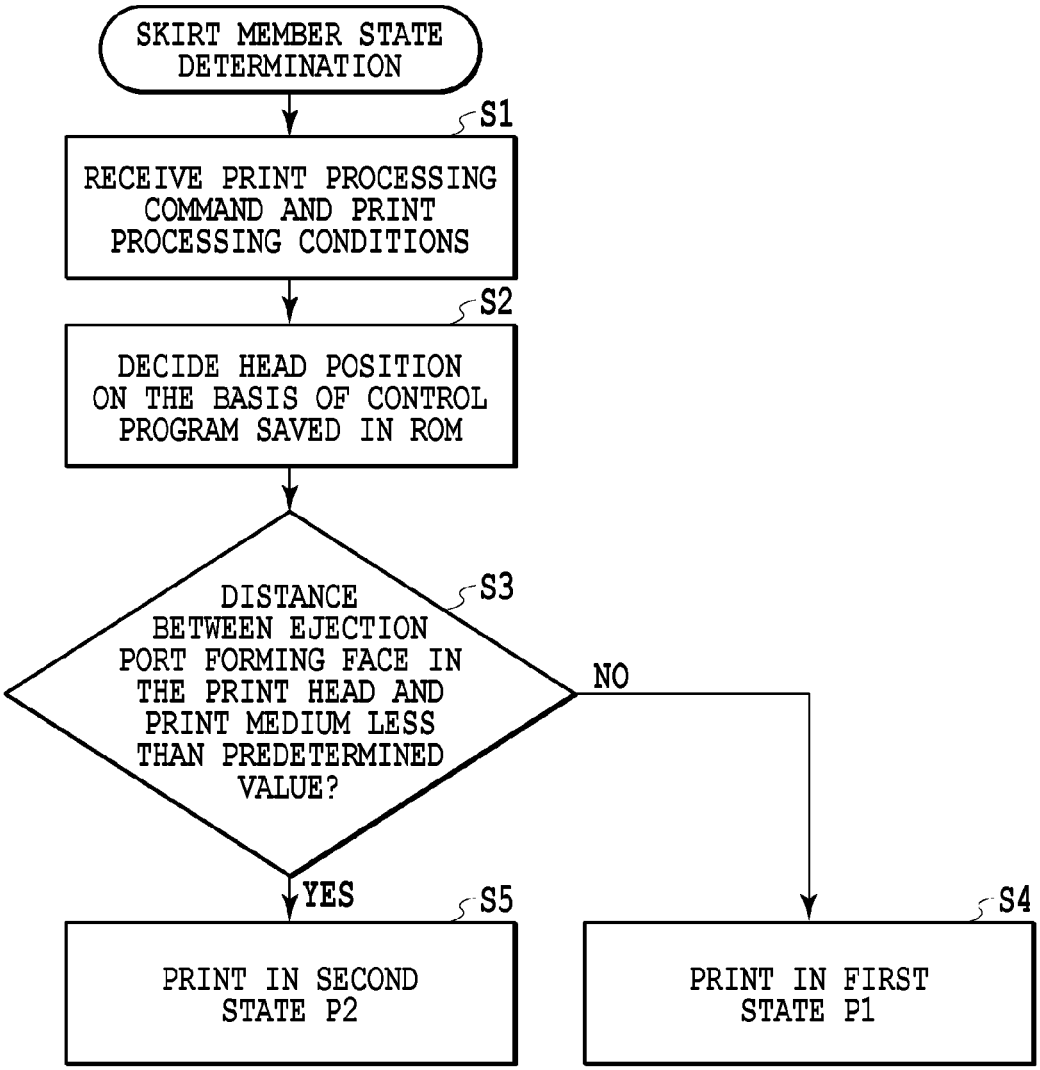
FIG. 7 is a flowchart illustrating a control flow.

FIG. 7 is a flowchart illustrating a control flow when deciding whether to perform printing operation with the skirt member 35 in the first state P1 or the second state P2. When printing operation is performed, the control unit of the inkjet printing apparatus 100 receives a print processing command from a host computer, together with information such as the type of sheet, print image data, and print mode configuration information (S1). In addition to the above information, a suitable head position is decided according to conditions in accordance with the control program, on the basis of measured values of the ambient temperature and humidity acquired in advance (S2). Next, it is determined whether or not the head/medium distance is less than a predetermined value (S3). In the flow of configuring the head position, if the head/medium distance is less than the predetermined value, printing operation is performed with the skirt member 35 in the second state P2 (S5). If the head/medium distance is equal to or greater than the predetermined value, printing operation is performed with the skirt member 35 in the first state P1 (S4).

According to the foregoing embodiment, it is possible to toggle a rectifying member between a rectifying state and a retracted state, and in addition, a mechanism that keeps the rectifying member in the retracted state while the carriage is moving is provided. Additionally, the rectifying member is toggled to the rectifying state or to the retracted state while the carriage is moving, according to at least one condition from among the distance between the print head and the sheet, and the movement speed of the carriage. Consequently, there is realized an excellent printing apparatus able to further minimize degradation in the quality of an image formed on a sheet compared to the related art.

Second Embodiment

Next, an inkjet printing apparatus according to the second embodiment of the present invention will be described. Note that parts configured similarly to the first embodiment above are designated with the same signs in the drawings and omitted from the description, and only the parts that differ are described.

The first embodiment describes a configuration in which a catch mechanism using magnetic force maintains the orientation of the skirt member 35 at a position that minimizes the amount of adhering ink mist. In contrast, in the second embodiment, gears and a belt suspended between the gears are used to retract the skirt member 35 to a position that reduces the amount of adhering ink mist, while also maintaining the orientation of the retracted skirt member 35 in the retracted state.

The configuration of the major parts of an inkjet printing apparatus according to the second embodiment of the present invention will be described using FIGS. 8A to 8F. FIGS. 8A to 8F are front views for illustrating process that the skirt member 35 moves from a position of rectifying the air current between the print head 2 and the sheet 1 to a position retracted from the ejection port forming face of the print head 2 so as to reduce the amount of adhering ink mist.

The configuration of the carriage 3 for toggling the skirt member 35 from the first state P1 to the second state P2 will be described.

Figure 8A:
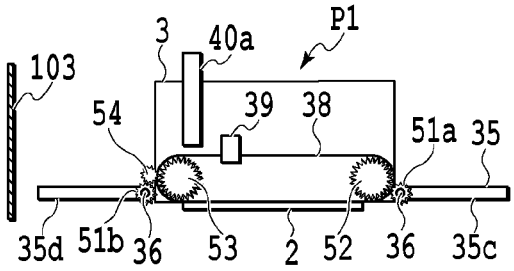
FIGS. 8A to 8F are diagrams explaining transitions of a skirt member between a rectifying state and a retracted state according to the second embodiment of the present invention.

As illustrated in FIG. 8A, gears 52 and 53 are each rotatably disposed on the carriage 3. A belt 38 is suspended between the gear 52 and the gear 53. In this way, the belt 38 is suspended between the two gears. A belt-moving member (moving member) 39 is fixedly attached to the belt 38. By fixedly attaching the belt-moving member 39 to the belt 38, the belt 38 moves similarly in response to the movement of the belt-moving member 39. When the belt-moving member 39 moves along the conveyance direction of the sheet 1, the belt 38 also moves in the same direction along the conveyance direction of the sheet 1. Also, as the belt 38 moves, the gears 52 and 53 rotate along the direction that the belt 38 moves.

Of the two skirt members 35 attached to the carriage 3, the skirt member 35*c* on one side will be described. The skirt member 35*c* is made up of a planar member. The skirt member 35*c* is disposed rotatable about a rotating shaft 36. A gear 51*a* is disposed on the outer side of the rotating shaft 36 in the radial direction. The gear 51*a* is able to rotate relative to the rotating shaft 36. In addition, the gear 51*a* is fixedly attached to the skirt member 35*c*, and unable to rotate relative to the skirt member 35*c*. When the gear 51*a* rotates, the rotating motion causes the skirt member 35*c* to also rotate about the rotating shaft 36 in the same direction. The gear 51*a* is disposed so as to engage with an adjacent gear 52. When the gear 52 rotates, the engaged gear 51*a* rotates along with the rotation of the gear 52. In this way, a gear 51*a* that the rotation of the gear 52 is transmitted is fixedly attached to the skirt member 35*c*.

Next, of the two skirt members 35 attached to the carriage 3, the skirt member 35*d* on the other side will be described. The skirt member 35*d* is made up of a planar member. The skirt member 35*d* is disposed rotatable about the rotating shaft 36. A gear 51*b* is disposed on the outer side of the rotating shaft 36 in the radial direction. The gear 51*b* is likewise able to rotate relative to the rotating shaft 36. In addition, the gear 51*b* is fixedly attached to the skirt member 35*d*, and unable to rotate relative to the skirt member 35*d*. When the gear 51*b* rotates, the rotating motion causes the skirt member 35*d* to also rotate about the rotating shaft 36 in the same direction. An intermediate gear 54 is disposed between the gear 51*b* and the gear 53. The gear 51*b* is disposed so as to engage with the gear 53 via the intermediate gear 54. In this way, a transmission mechanism including a belt 38 and gears 51*a*, 51*b*, 52, 53, and 54 for rotating the skirt member 35 is provided on the carriage 3.

Side plates 102 and 103 of the body frame of the inkjet printing apparatus 100 are disposed at both ends of the movable range of the carriage 3. The side plate 102 is disposed at the end of the movable range of the carriage 3 on the side corresponding to the skirt member 35*c* and the gear 52. Meanwhile, the side plate 103 is disposed at the end of the movable range of the carriage 3 on the side corresponding to the skirt member 35*d* and the gear 53.

Abutting members 40*a* and 40*b* are respectively disposed on both ends, at positions set inward a predetermined distance from the side plates 102 and 103 disposed at both ends of the movable range of the carriage 3. In the present embodiment, the abutting member 40*a* is disposed at a position separated by a predetermined distance x from the side plate 103 on the side of the inkjet printing apparatus corresponding to the skirt member 35*d* and the gear 53. Meanwhile, the abutting member 40*b* is disposed at a position separated by a predetermined distance y from the side plate 102 on the side of the inkjet printing apparatus corresponding to the skirt member 35*c* and the gear 52. The abutting members 40*a* and 40*b* are fixedly attached to the body frame (not illustrated).

Figure 8B:
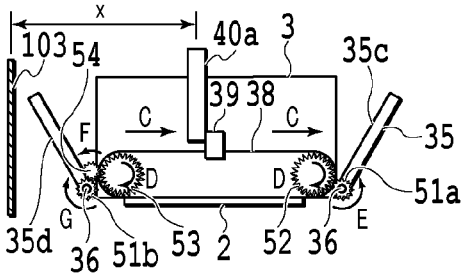

Next, the operation of the carriage 3 and the skirt member 35 for toggling the skirt member 35 from the first state P1 to the second state P2 will be described. To toggle the skirt member 35 from the first state P1 for rectifying the air current between the print head 2 and the sheet 1 to the retracted second state P2 that reduces the amount of adhering ink mist, the carriage 3 is moved near the end on the skirt member 35*d* side. After the carriage 3 is moved near the end of the movable range on the skirt member 35*d* side, the belt-moving member 39 attached to the belt 38 abuts the abutting member 40*a* fixedly attached to the body frame of the inkjet printing apparatus. If the carriage 3 is moved farther to the skirt member 35*d* side, as illustrated in FIG. 8B, the belt-moving member 39 is pushed by the abutting member 40*a*, thereby causing the belt-moving member 39 to move to the skirt member 35*c* side relative to the carriage 3. By moving the belt-moving member 39 to the skirt member 35*c* side relative to the carriage 3, the belt 38 moves in the C direction indicated in FIG. 8B with respect to the carriage 3. Since the belt 38 moves in the C direction, the gears 52 and 53 on which the belt 38 is suspended rotate in the D direction.

As a result of the gear 52 rotating in the D direction, the gear 51*a* engaged with the gear 52 rotates in the E direction, and the rotation of the gear 51*a* causes the skirt member 35*c* to rotate in the same direction as the E direction about the rotating shaft 36. Similarly, as a result of the gear 53 rotating in the D direction, the intermediate gear 54 engaged with the gear 53 rotates in the F direction. When the intermediate gear 54 rotates in the F direction, the gear 51*b* engaged with the intermediate gear 54 correspondingly rotates in the G direction, and the rotation of the gear 51*b* causes the skirt member 35*d* to rotate in the same direction as the G direction about the rotating shaft 36. In this way, by rotating about the rotating shaft 36, the skirt member 35 moves to the retracted state.

In other words, if the carriage 3 moves to the end of the movable range, the belt-moving member 39 (member) attached to part of the belt 38 abuts the abutting member 40*a* (stationary part) of the apparatus, and the belt 38 rotates. The rotation of the belt 38 is transmitted by a transmission mechanism such as the gears 51*a*, 51*b*, 52, 53, and 54, and as a result, the skirt member 35 rotates.

Figure 8C:
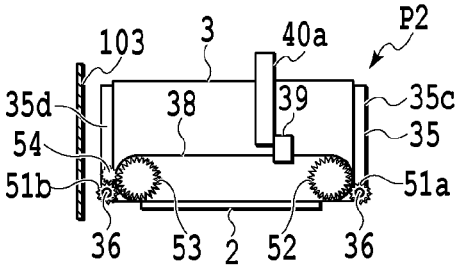

If the carriage 3 moves farther towards the skirt member 35*d* until the skirt member 35 reaches the upright state as illustrated in FIG. 8C, the orientation of the skirt members 35*c* and 35*d* is maintained as a result. At this point, the orientation of the skirt members 35*c* and 35*d* is maintained due to factors such as frictional resistance and mechanical resistance produced between the belt 38 and each of the gears 52, 53, 51*a*, 51*b*, and the intermediate gear 54. Consequently, by moving the carriage 3 near the end on one side of the movable region of the carriage 3, the skirt member 35 can be changed from the first state P1 to the second state P2. In this way, if the carriage 3 approaches the end on one side of the reciprocating movement, the skirt member 35 is toggled from the rectifying state to the retracted state.

In the second embodiment, the belt-moving member 39 and the abutting member 40*a* are made to abut, and the carriage 3 is made to move farther from that point to move the belt-moving member 39 with respect to the carriage 3. Consequently, the belt 38 is moved, causing the gears 51*a*, 51*b*, 52, 53, and 54 to rotate, and thereby retracting the skirt member 35 to the retracted state. In the second embodiment, the belt-moving member 39, the abutting member 40*a*, the belt 38, and the gears 51*a*, 51*b*, 52, 53, and 54 function as a moving mechanism that moves the skirt member 35 between the rectifying state and the retracted state.

Figure 8D:
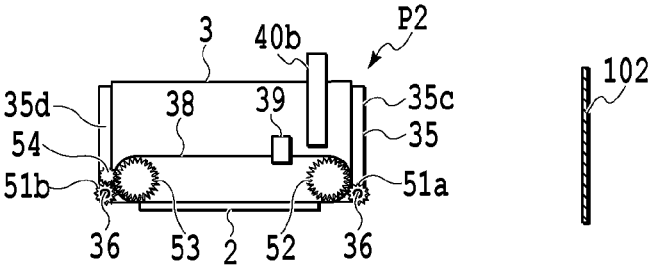
Figure 8E:
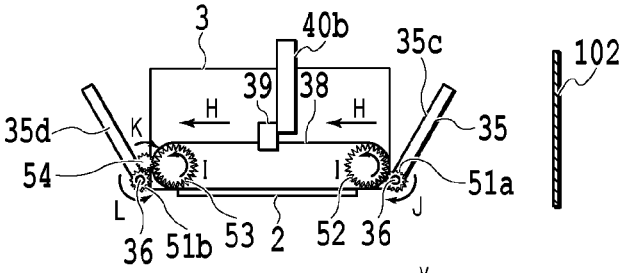

Next, the operation of the carriage 3 and the skirt member 35 for toggling the skirt member 35 from the second state P2 to the first state P1 will be described. To return the skirt member 35 from the second state P2 to the first state P1, the carriage 3 is moved near the end of the movable range on the skirt member 35*c* side, as illustrated in FIG. 8D. After the carriage 3 is moved near the end of the movable range on the skirt member 35*c* side, the belt-moving member 39 attached to the belt 38 abuts the abutting member 40*b*. If the carriage 3 is moved farther to the skirt member 35*c* side, the belt-moving member 39 is pushed by the abutting member 40*b*, thereby causing the belt-moving member 39 to move to the skirt member 35*d* side relative to the carriage 3. By moving the belt-moving member 39 to the skirt member 35*d* side relative to the carriage 3, the belt 38 moves in the H direction indicated in FIG. 8E with respect to the carriage 3. Since the belt 38 moves in the H direction, the gears 52 and 53 on which the belt 38 is suspended rotate in the I direction.

As a result of the gear 52 rotating in the I direction, the gear 51*a* engaged with the gear 52 rotates in the J direction, and the rotation of the gear 51*a* causes the skirt member 35*c* to rotate in the same direction as the J direction about the rotating shaft 36. Similarly, as a result of the gear 53 rotating in the I direction, the intermediate gear 54 engaged with the gear 53 rotates in the K direction. When the intermediate gear 54 rotates in the K direction, the gear 51*b* engaged with the intermediate gear 54 correspondingly rotates in the L direction, and the rotation of the gear 51*b* causes the skirt member 35*d* to rotate in the same direction as the L direction about the rotating shaft 36.

Figure 8F:
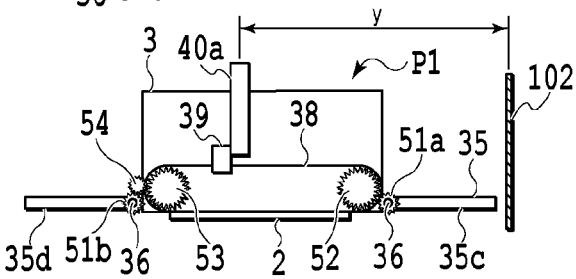

If the carriage 3 moves farther towards the skirt member 35*c* until the skirt members 35*c* and 35*d* reach an orientation nearly parallel to the direction in which the sheet 1 extends, as illustrated in FIG. 8F, the rotation of the skirt members 35*c* and 35*d* is stopped as a result. The orientation of the skirt members 35*c* and 35*d* is maintained at this position. Consequently, the skirt member 35 is toggled from the second state P2 to the first state P1. In this way, if the carriage 3 approaches the other end on the opposite side of the one end of the reciprocating movement when toggling the skirt member 35 from the rectifying state to the retracted state, the skirt member 35 is toggled from the retracted state to the rectifying state.

According to the inkjet printing apparatus of the present embodiment, since a belt 38 is suspended between gears 52 and 53, rotation of the belt 38 causes the two skirt members 35 provided on both sides of the carriage 3 to also rotate in conjunction. Consequently, by moving the carriage 3 to one end of the movable range, the state of both skirt members 35 can be toggled. For this reason, compared to the inkjet printing apparatus of the first embodiment, the state of both skirt members 35 can be toggled with less movement by the carriage 3. Since the state of the skirt members 35 may be toggled immediately, by shortening the wait time until the state of the skirt members 35 are toggled, it is possible to provide an inkjet printing apparatus with greater usability without imposing a burden on the user.

Note that although the second embodiment above describes a configuration in which two skirt members 35 are attached to the carriage 3 and the two skirt members 35 move to the retracted state at the same time, the present invention is not limited thereto. A configuration in which one skirt member is attached to the carriage 3 and the one skirt member 35 moves to the retracted state via a gear is also acceptable.

Also, in the second embodiment, the belt-moving member 39 and the abutting member 40*a* are made to abut, and the carriage 3 is made to move farther from that point to move the belt-moving member 39 with respect to the carriage 3, but the present invention is not limited thereto. A configuration in which a separate driving source is disposed, and the gears 52 and 53 are driven by the separate driving source to move the skirt member 35 to the retracted state is also acceptable. Additionally a configuration in which the gears 52 and 53 are driven by a different configuration is also acceptable.

Note that although the foregoing two embodiments both decide whether or not to retract on the basis of the distance between the print head and the sheet (head/medium distance) as a condition, a condition other than the above is also conceivable. For example, the movement speed of the carriage during printing may also be treated as a condition. When the movement speed of the carriage 3 is low, the amount of air current flowing between the print head 2 and the sheet 1 on the downstream side is small, and thus the "mist haze" of the image is reduced. For this reason, a good image may be obtained even without rectification on the upstream side. Conversely, when the movement speed of the carriage is high, an image is more readily degraded by "mist haze" unless the air is rectified upstream. Consequently, it is preferable to decide whether or not to retract the skirt member 35 on the basis of the movement speed of the carriage 3. The control unit performs control to put the skirt member in the rectifying state in the case of a high-speed print mode in which the constant movement speed of the carriage during printing exceeds a configured threshold, and to put the skirt member in the retracted state in the case of a low-speed print mode that does not exceed the threshold. If the rectifying member is retracted when not needed in this way, further soiling of the bottom face of the rectifying member is minimized. Soiling of the sheet caused by accumulated ink mist on the bottom face of the rectifying member dripping onto the sheet is minimized, and as a result, good image quality can be maintained over a longer period compared to the related art.

Note that whether or not to retract the skirt member 35 may also be decided according to a compound assessment of the two conditions of head/medium distance and carriage movement speed. A decision may also be made while accounting for additional conditions.

In addition, in the foregoing embodiments, the skirt member 35 is attached on the outward side at both ends of the carriage 3 along the main scanning direction. However, the skirt member 35 is attached for the purpose of rectifying the air current flowing between the print head 2 and the sheet 1. Consequently, it is sufficient for the skirt member 35 to be attached on at least the upstream side of the direction in which the air current flows. In other words, it is sufficient for the skirt member 35 to be attached to the carriage 3 so as to extend from the carriage 3 towards the upstream side of the movement of the carriage 3. For this reason, if for example the inkjet printing apparatus uses a one-way printing format that performs printing operating in only one movement direction, it is sufficient for the skirt member 35 to be attached to the carriage 3 on only the upstream side of the movement direction during printing. In this case, a single skirt member 35 may be attached on only one side of the carriage 3. In this case, there is little soiling of the skirt member by ink mist generated as a result of movement by the carriage while ejecting ink, but soiling of the skirt member by floating ink mist as the carriage returns does occur. Consequently, even in the case of a configuration provided with a skirt member on just one side, retracting the skirt member according to ink mist adherence conditions is still effective.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-051989 filed Mar. 14, 2014, which is hereby incorporated by reference herein in its entirety.

What is claimed is:

1. A printing apparatus comprising:

a carriage that performs reciprocating movement, mounted with a print head that ejects ink;

a rectifying member, extending from the carriage in a movement direction of the carriage, that rectifies air flowing under the print head when the carriage moves, wherein the rectifying member can be toggled between a rectifying state and a retracted state, wherein the rectifying member is provided on both sides of the carriage with respect to the movement direction, and the rectifying member is a planar member rotatably supported on the carriage freely; and a mechanism that keeps the rectifying member in the retracted state while the carriage moves, and the rectifying member is toggled by a movement of the carriage, wherein, when the carriage approaches an end, the rectifying member in the rectifying state rotates while the rectifying member abuts a stationary part of the apparatus and is toggled to the retracted state, and wherein the mechanism includes a magnet catch, and the rectifying member toggled to the retracted state is held by a magnetic force.

2. The printing apparatus according to claim 1, wherein the rectifying member is set to the rectifying state or to the retracted state according to at least one of a distance between the print head and a sheet, and a movement speed of the carriage.

3. The printing apparatus according to claim 1, wherein in a case of toggling a state of the rectifying member, the carriage is moved to a toggle position near an end of the reciprocating movement, and in a case of maintaining a state of the rectifying member without toggling, the carriage performs reciprocating movement by reversing direction farther inward than the toggle position.

4. The printing apparatus according to claim 1, wherein when the carriage approaches the end again and the rectifying member in the rectifying state abuts the stationary part, the magnet catch releases the rectifying member.

5. A printing apparatus comprising:

a carriage that performs reciprocating movement, mounted with a print head that ejects ink;

a rectifying member, extending from the carriage in a movement direction of the carriage, that rectifies air flowing under the print head when the carriage moves, wherein the rectifying member can be toggled between a rectifying state and a retracted state, wherein the rectifying member is provided on both sides of the carriage with respect to the movement direction, and the rectifying member is a planar member rotatably supported on the carriage; and a mechanism that keeps the rectifying member in the retracted state while the carriage moves, and the rectifying member is toggled by a movement of the carriage, wherein the carriage is provided with a transmission mechanism including a belt and a gear for rotating the rectifying member, and when the carriage approaches an end, a member attached to part of the belt abuts a stationary part of the apparatus, the belt rotates, and the rectifying member rotates via the transmission mechanism.

6. The printing apparatus according to claim 5, wherein rotation of the belt causes two of the rectifying members provided on both sides of the carriage to rotate in conjunction.

7. The printing apparatus according to claim 5, wherein when the carriage approaches one end of the reciprocating movement, the rectifying member is toggled from the rectifying state to the retracted state by the transmission mechanism, and when the carriage approaches another end of the reciprocating movement, the rectifying member is toggled from the retracted state to the rectifying state by the transmission mechanism.

8. The printing apparatus according to claim 5, wherein the rectifying member is set to the rectifying state or to the retracted state according to at least one of a distance between the print head and a sheet, and a movement speed of the carriage.

* * * * *